United States Patent [19]

Borcenk et al.

[11] Patent Number: 4,530,611

[45] Date of Patent: Jul. 23, 1985

[54] PRINTHEAD MOUNTING/DEMOUNTING MECHANISM

[75] Inventors: Frank Borcenk, Pennsburg; Jeffry A. Forsythe, Berwyn, both of Pa.; Frank L. Roe, Brookfield Center, Conn.

[73] Assignee: Exxon Research and Engineering Co., Florham Park, N.J.

[21] Appl. No.: 480,665

[22] Filed: Mar. 31, 1983

[51] Int. Cl.[3] ..... B41J 3/04; B41J 25/30

[52] U.S. Cl. ..... 400/175; 400/126; 400/357; 400/56; 400/692; 220/23.4; 24/615; 24/639; 24/241 SL; 24/611

[58] Field of Search ..... 400/126, 175, 208, 357, 400/55, 56, 59, 692, 320, 352; 220/23.4, 23.86; 24/241 SL, 201 A, 239, 201 C, 230 BC, 252 R, 255 SL, 612, 615, 639; 101/415.1

[56] References Cited

U.S. PATENT DOCUMENTS

| | | | |
|---|---|---|---|
| 1,382,349 | 6/1921 | Etheridge | 400/357 |
| 3,201,840 | 8/1965 | Jantzen | 24/639 |
| 3,439,390 | 4/1969 | Prete, Jr. | 24/201 A |
| 3,481,629 | 12/1969 | Harper | 220/23.4 |
| 3,826,345 | 7/1974 | Miller | 400/175 |
| 3,946,865 | 3/1976 | Bierwas | 220/23.4 |
| 3,973,496 | 8/1976 | Cerny et al. | 101/415.1 |
| 4,133,264 | 9/1979 | Fermi et al. | 101/415.1 |
| 4,239,107 | 12/1980 | Boyatt, Jr. et al. | 400/208 |
| 4,271,888 | 6/1981 | Robinson | 24/201 A |
| 4,325,646 | 4/1982 | Sasaki | 400/208 |
| 4,350,448 | 9/1982 | Hanagata | 400/175 |
| 4,357,060 | 11/1982 | Kuhn | 400/692 |
| 4,359,288 | 11/1982 | Bullock | 400/208 |
| 4,362,406 | 12/1982 | Choberka et al. | 400/124 |
| 4,363,559 | 12/1982 | Suzuki et al. | 400/175 |
| 4,399,913 | 8/1983 | Gelardi et al. | 220/23.4 |
| 4,405,246 | 9/1983 | Suzaki | 400/357 |
| 4,408,914 | 10/1983 | Ciesiel et al. | 400/208 |

FOREIGN PATENT DOCUMENTS

| | | | |
|---|---|---|---|
| 2407820 | 7/1979 | France | 400/56 |
| 56-56893 | 5/1981 | Japan | 400/55 |

OTHER PUBLICATIONS

Perry, "Thermal Print Head Control", IBM Technical Disclosure Bulletin, vol. 21, No. 4, pp. 1594–1595, 9/78.

*Primary Examiner*—William Pieprz
*Attorney, Agent, or Firm*—Kenneth Watov

[57] ABSTRACT

A trolley of a printer includes a pair of angularly upright projecting dovetail-like fingers spaced apart near a left edge thereof, and a spring biased wedge pin located near a right edge thereof, for slideably engaging chamfer-like surfaces on the left and right-hand sides of a printhead assembly, respectively, for permitting the assembly to be snapped into and out of retention upon the trolley, the trolley further including right and left hand leaf springs located near its rear edge for pushing the printhead assembly forward toward the front edge of the trolley to a forwardmost position determined by one of the pair of dovetail-like fingers striking a "stop" located upon one side of the printhead assembly for preventing further forward movement, whereas the printhead assembly is pushed rearward upon the trolley in the event of a paper jam developing between the printhead and a platen.

15 Claims, 14 Drawing Figures

PRINTHEAD MOUNTING/DEMOUNTING MECHANISM

The field of the present invention relates generally to printers, and more specifically to mechanisms for providing mounting and demounting of printheads utilized in such printers.

In printers requiring relative movement between a printhead and a platen carrying a print medium, such as paper, the basic printer design must ensure long-term reliability, relatively easy maintenance, substantial freedom from "print medium or paper jams" causing damage to the printhead or other printer mechanisms, and automatic anti-jam capability. Also, mechanisms of such printers are enhanced in printer systems providing for easy insertion and removal of the printhead from the trolley or other printer mechanism to which the printhead is attached during normal operation of the printer. Examples of different mechanisms for providing this latter function are shown in U.S. Pat. Nos. 3,958,254 and 4,229,114.

The present invention overcomes many of the problems in the prior art by incorporating within a unique mounting/demounting mechanism for a printhead the additional features of means for both protecting the printhead from damage due to paper jams and providing within a range automatic clearance of developing paper jams, all while avoiding interruption of the operation of the printer.

In the drawings, wherein like items are indicated by the same reference designation:

Figure 8:
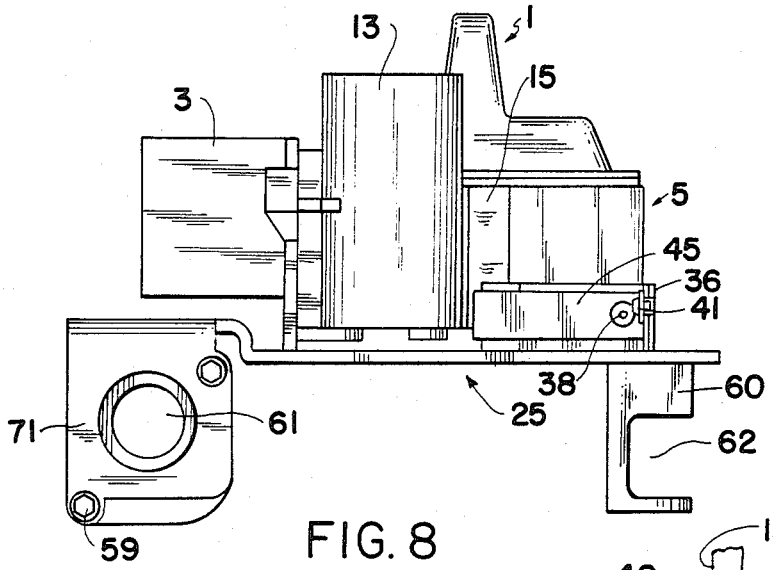
FIG. 8 is a right-side elevation view of the assembly of FIG. 7.
Figure 8A:
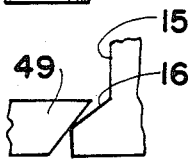

FIG. 8*a* shows the preferred contact between a wedge pin and chamfer surface of a nest assembly, of one embodiment of the invention.

Figure 7:
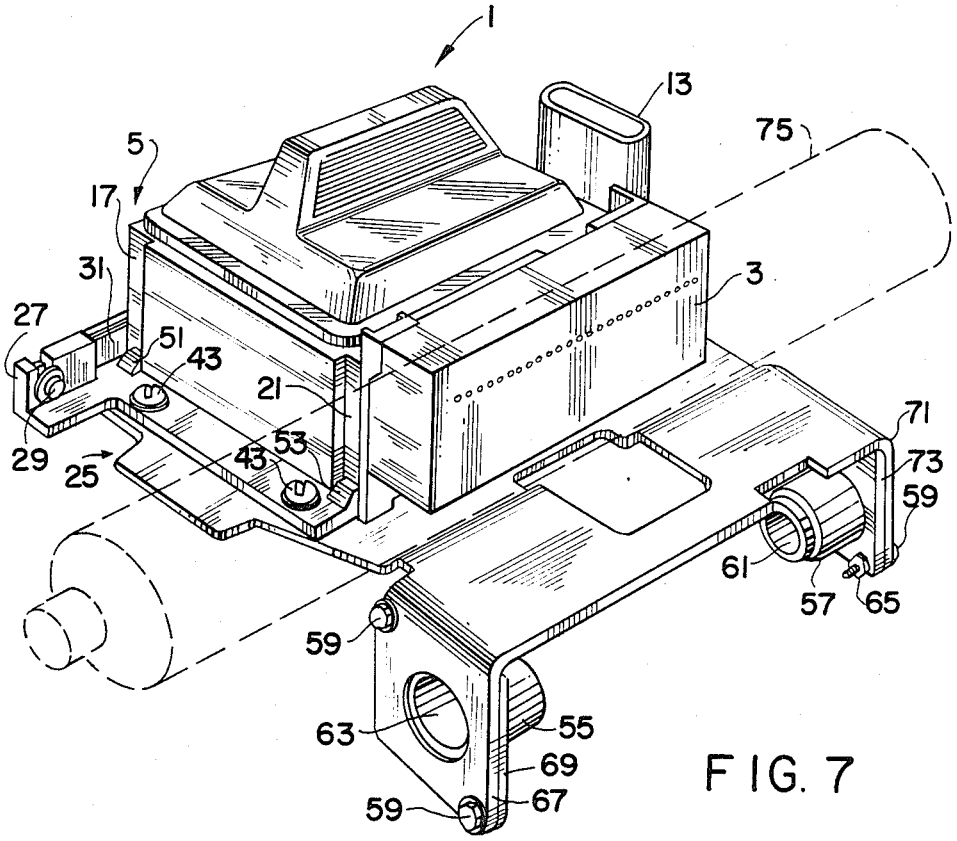
FIG. 7 is an assembly view of the exploded perspective view shown in FIG. 1.
Figure 9:
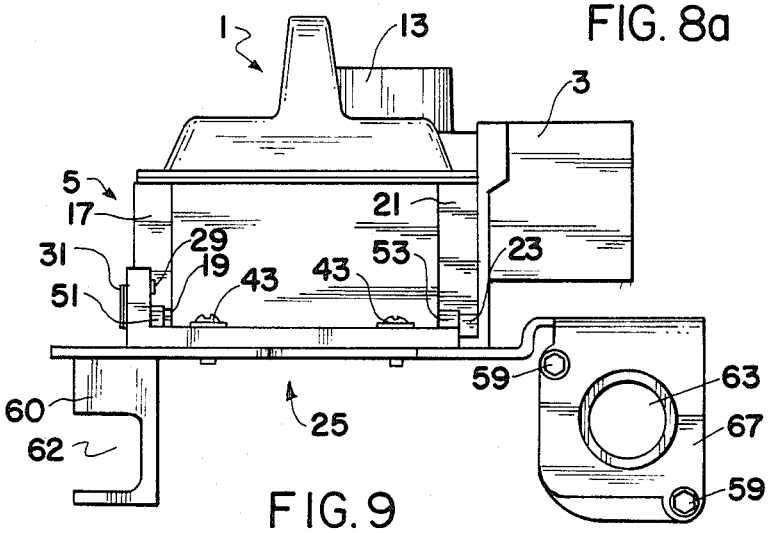
Figure 9A:
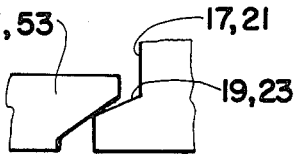

FIG. 9 is a left-side elevation view of the assembly of FIG. 7;

FIG. 9*a* shows the preferred contact between various wedge-like or "dovetail" surfaces of one embodiment of the invention.

Figure 10:
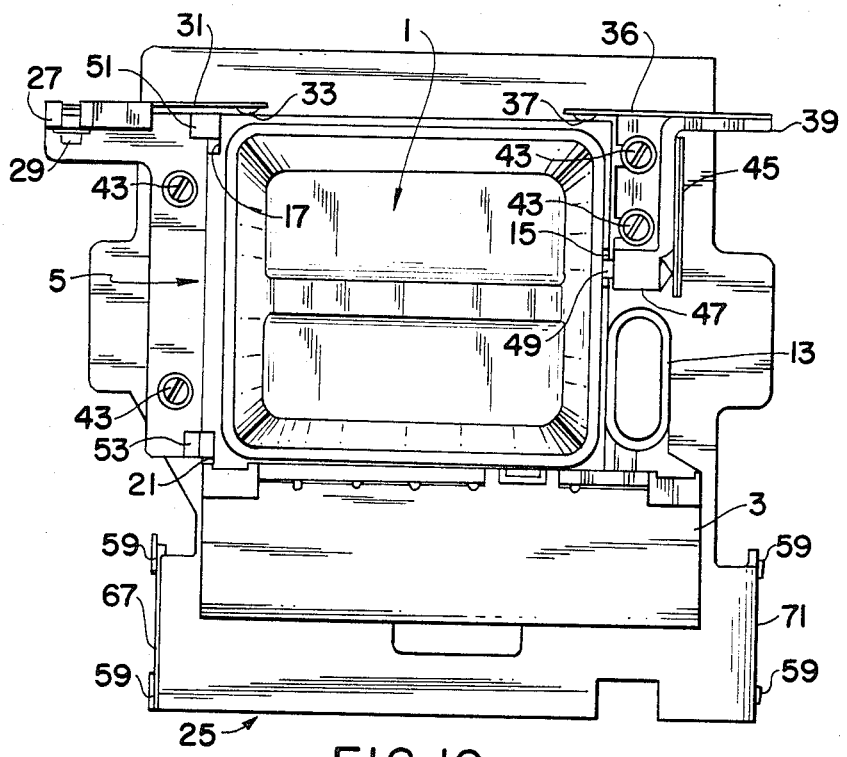
Figure 11:
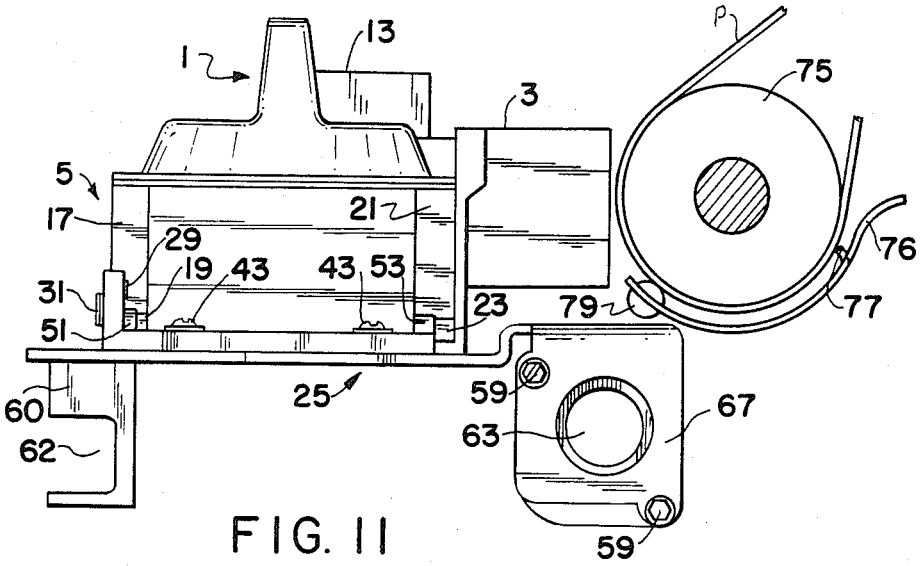
Figure 12:
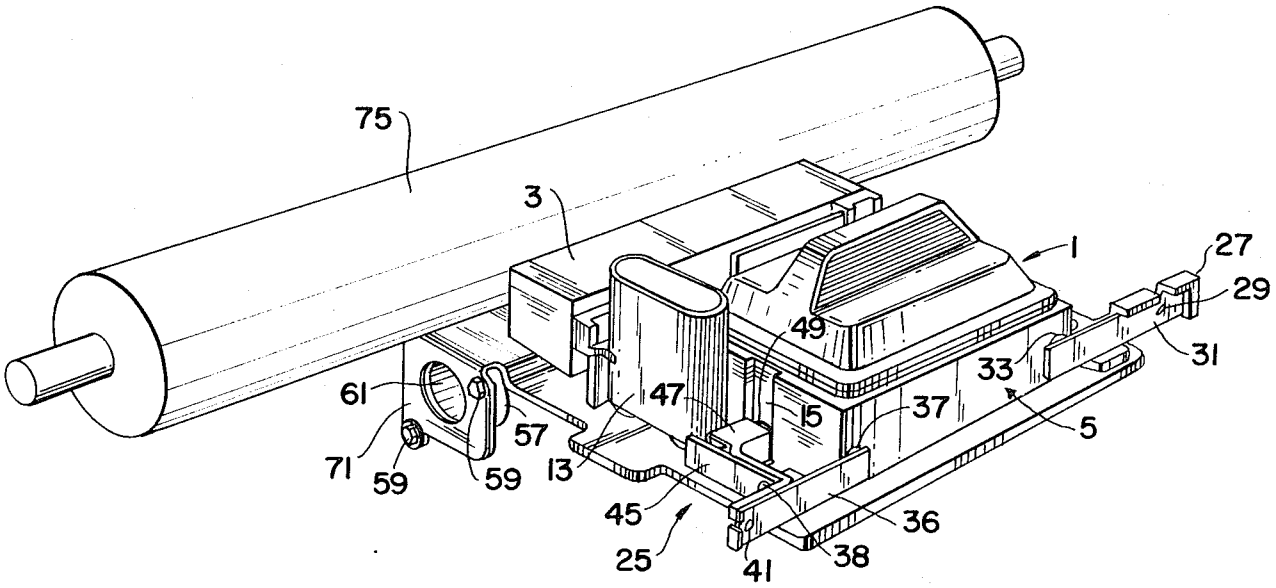

FIG. 10 is a top plan view of the assembly of FIG. 7;

FIG. 11 is a left-side elevation view of FIG. 7 further including a portion of the platen, associated paper guide, a thickness gauge finger, pinch roller, and a portion of a paper wrapped partially around the platen; and FIG. 12 is a perspective view of the right and back sides of the assembly of FIG. 7.

With reference to FIGS. 1–12, a detailed description of the present invention as used in a particular ink-jet printer is shown for the purpose of illustration only, and not meant to be limiting. The various embodiments of the invention as shown and described herein can be incorporated for use in many other types of printing mechanisms including but not limited to pin matrix printers, wire-matrix printers, thermo-matrix printers, and electro-sensitive matrix printers, for example. In addition, the present invention may be useful in other printers including relative movement between a printhead and a platen.

Figure 1:
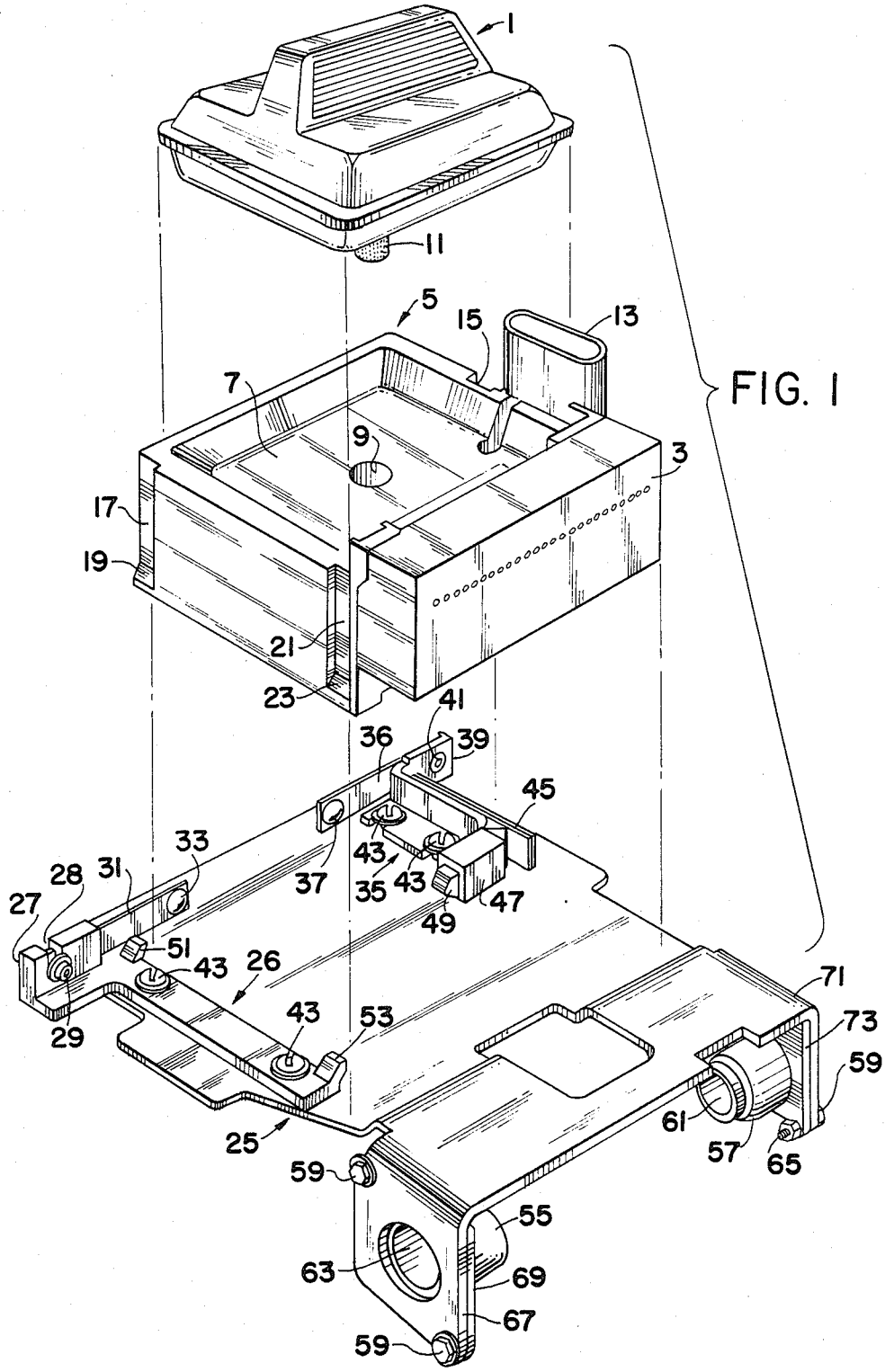
FIG. 1 is an exploded perspective view of a portion of a printer, in this example an ink-jet printer, including one embodiment of the invention.
Figure 2:
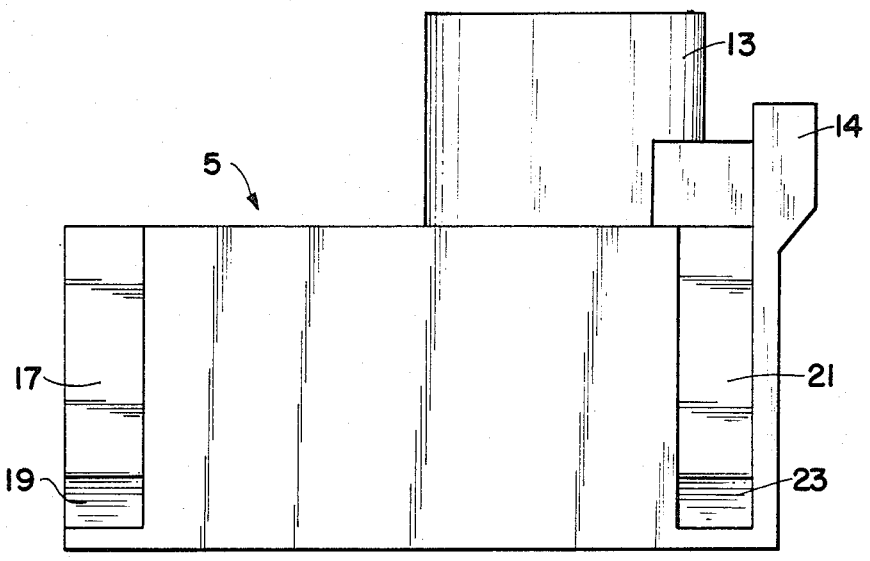
FIG. 2 is a left-side elevation view of the "ink nest" assembly shown in FIG. 1.

With reference to FIG. 1, a portion of an ink-jet printer incorporating one embodiment of the present invention, in this example, includes a disposable ink cartridge 1 that is insertable in an ink nest assembly 5.

Figure 3:
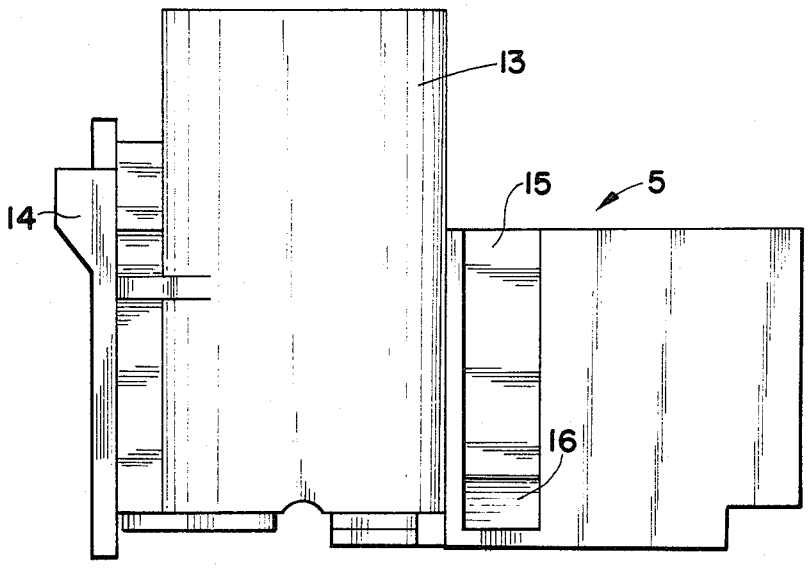
FIG. 3 is a right-side elevation view of the "ink nest" assembly shown in FIG. 1.

The ink nest assembly 5 includes a recessed receptacle portion 7 for receiving the bottom portion of the cartridge 1, and further includes a centrally located hole 9 for receiving a delivery tube 11 of the cartridge 1. A printhead 3 is shown mounted upon the nest assembly 5. Also, the nest assembly 5 further includes a bubble trap 13, a vertical slotway 15 located in about the center of the right side of the nest assembly 5, and two other vertically oriented slotways 17 and 21 located on its left side, each of the latter two terminating in a "dovetail" chamfer 19 and 23, respectively. The slotway 15 terminates similarly in a "dovetail" like chamfer 16 as shown in FIG. 3. The location of the slotways 17 and 21 are further illustrated in FIG. 2, which also shows the mounting boss 14 to which the printhead 3 is mounted. The trolley assembly 25 includes a wedge plate or bracket assembly 26, including an upright bracket 27 including a slot 28 for retaining (via a rivet or screw 29) a leaf spring 31, the leaf spring 31 having an anti-friction "button" 33 rigidly connected to its free end, a pair of screws 43 for securing the wedge plate assembly 26 to the trolley 25, for example, and a pair of angularly upward projecting "dovetail" fingers 51 and 53 for coacting with the slotway and associated "dovetail" chamfer surfaces (17, 19), and (21, 23), respectively, of the nesting assembly 5. Also included as a subassembly of the trolley assembly 25 is a wedge pin assembly 35 including a leaf spring 36 having an antifriction button 37 rigidly connected to its free end, and its other end secured to an upright bracket 39 via a rivet or screw 41; screws 43 for securing the wedge pin assembly 35 to the trolley assembly 25; and a leaf spring 45 for spring biasing a "dovetail" wedge pin 49 within a housing 47. The trolley assembly 25 further includes bushing holders 55 and 57 formed on bushing brackets 69 and 73, respectively, for retaining antifriction bushings 63 and 61, respectively. The bushing brackets 69 and 73 are secured downwardly projecting vertical arms 67, 71, respectively, of the trolley, via screws 59 and nuts 65, as partially shown.

Figure 4:
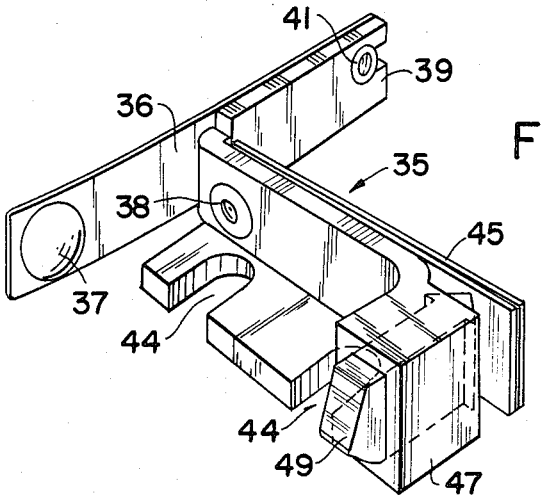
FIG. 4 is a detailed perspective view of the wedge pin assembly shown in FIG. 1.
Figure 6:
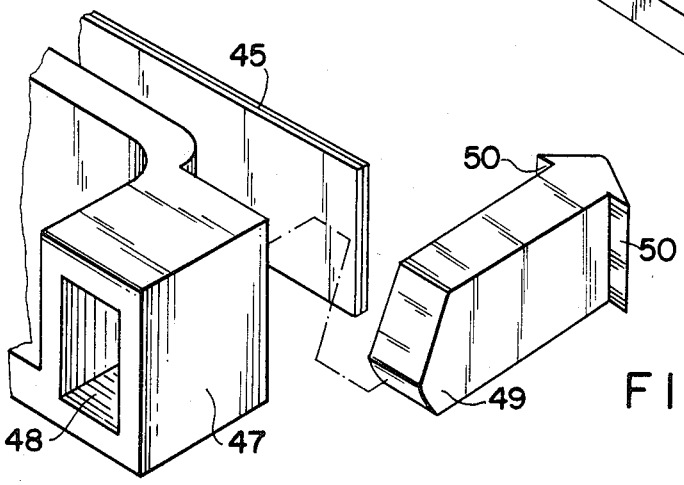
FIG. 6 is an exploded pictorial view showing details of the wedge pin, its holder, and spring biasing of the wedge pin assembly shown in FIG. 4.

The wedge pin assembly 35 is shown in greater detail in FIG. 4. Note that in this example slots 44 are included for facilitating mounting of the assembly 35 via screws 43 to the trolley assembly 25. Also in this example, a rivet 38 is used to secure the leaf spring 45 to the bracket 39. In FIG. 6, an exploded view of the area of the wedge pin assembly 35 about the wedge pin 49 shows that the wedge pin 49 is captively mounted within the hole 48 via the flanges 50 preventing the wedgepin from being pushed through the hole 48 by the spring biasing imposed by the leaf spring 45.

Figure 5:
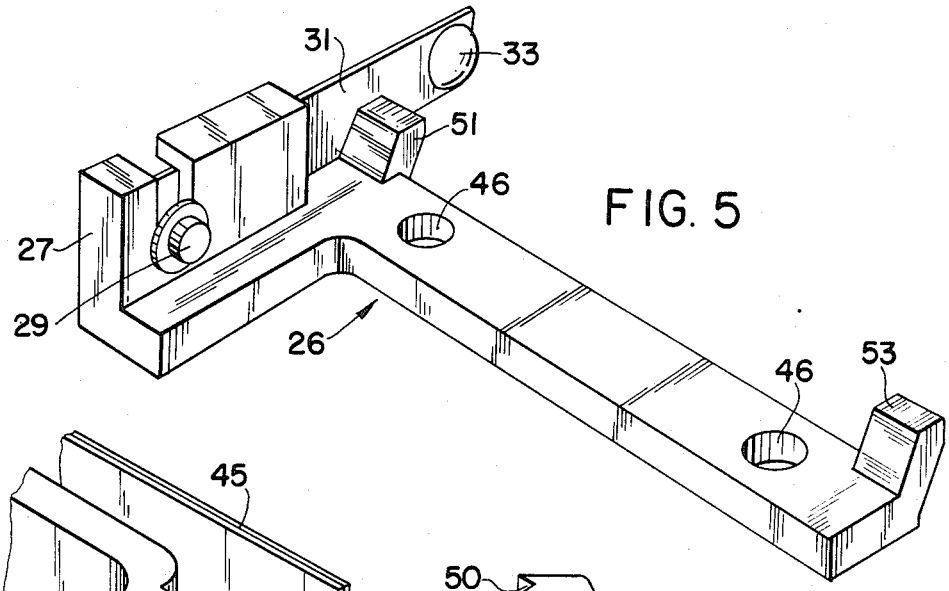
FIG. 5 is a detailed pictorial view of the wedge bracket assembly shown in FIG. 1.

In FIG. 5, a more detailed view of the wedge bracket or plate assembly 26 is shown, including holes 46, clearance holes for the screws 43 to secure the wedge plate assembly 26 upon the trolley 25. Note that the slots 44 of the wedge pin assembly 35 shown in FIG. 4, provide for a range of adjustment of the positioning of this assembly upon the trolley 25 relative to the positioning of the wedge plate assembly 26.

In FIG. 7, an assembly view is shown, wherein the ink cartridge 1 is plugged into the nest assembly 5, the nest assembly 5 carrying the printhead 3 is secured to the trolley 25 via the "dovetail" fingers 51 and 53 of the wedge plate assembly 26 coacting with the slotways 17 and 21 of the nest assembly 5, respectively, and the wedge pin 49 of the wedge pin assembly 35 is coacting with the slotway 15 of the nest assembly 5 (see FIG. 12). A platen 75 is shown in phantom as it might be positioned in a typical printer. As shown in FIGS. 8 and 9, respectively, the trolley assembly 25 further includes a "C"-bracket 60 having an opening 62 for mounting upon a rear guide rail (not shown). Similarly the trolley assembly 25 is mounted to a front guide rail (not shown) via the insertion of this rail through the bushings 61 and 63. In this example, the trolley moves upon the guide rails to permit the print-head 3 to be moved from opposite one end of the platen 75 to the other end for printing upon the print medium P (see FIG. 11) via a transport mechanism that is not shown, and could be any of a number of known such transport mechanisms.

With reference to FIG. 11, note that the platen 75 is shown, in this example, to have a print medium "P" wrapped partially around its circumference. A paper-guide 76 of the printer includes a pinch roller 79 for holding the print medium P (paper in this example) against the platen 75, and a gauge finger 77 for substantially limiting the thickness of paper that can be inserted into the printer.

Operation of the present invention will now be described in detail with reference to the figures, and especially with reference to the assembly views shown in FIGS. 7–12. The printhead 3 and its associated nest assembly 5 are secured to the trolley assembly 25 by holding the nest assembly 5 at an angle for positioning the chamfer or "dovetail" surfaces 19 and 23 of the slotways 17 and 21 of the nest assembly 5 under the "dovetail" fingers 51 and 53, respectively, of the wedge plate assembly 26, and then pushing down upon the other end of the nest assembly until the dovetail wedge pin 49 snaps into the slotway 15 and coacts with the dovetail chamfer 16 of slotway 15. The nest assembly 5 is removed from the trolley 25 in the opposite manner by exerting force on the right side of the nest assembly 5 to disengage slotway 15 thereof from the wedge pin 49, and then move the nest assembly 5 in a direction away from the wedge plate assembly 26. In a preferred embodiment of the invention the coaction of "dovetail" fingers 51 and 53 with the slotways 17 and 21, respectively, and associated "dovetail-like" chamfer surfaces 19 and 23, respectively, provide for highly accurate alignment of the nest assembly 5 upon the trolley assembly 25, for ensuring the necessary spacing and parallelism between the printhead 3 and the platen 75. FIG. 8*a* shows the preferred contact between wedge pin 49 and chamfer surface 16. Similarly, FIG. 9*a* shows the preferred contact between wedge or dovetail fingers 51 and 53, and chamfer or dovetail surfaces 19 and 23, respectively.

The wedge pin 49, via the spring biasing provided by spring 45, maintains a sufficient horizontally aligned force against the right side of the nest assembly 5 for urging and maintaining the left side into appropriate mechanical engagement with the dovetail fingers 51 and 53 of the wedge plate assembly 26. Concurrently, the springs 31 and 36 (via antifriction buttons 33, 37, respectively) push against the backside of the nest assembly 5 for pushing it and its associated printhead 3 toward the platen 75. In this example, as shown in FIGS. 9 and 11, the rearward wall of the slotway 21 provides a "stop" in coaction with the dovetail finger 53 of wedge plate assembly 26, for both limiting the forward movement of the nest assembly 5 and ensuring maintenance of required spacing between the printhead 3 and the platen 75. In normal operation, the dovetail finger 51 of wedge plate assembly 26 does not touch the forward wall of the slotway 17 of the nest assembly 5. Also, as shown in FIG. 10, the dovetail wedge pin 49 does not touch either wall of the slotway 15 of the nest assembly 5 in normal operation. Such normal operation is maintainable for a range of print medium or paper thicknesses.

If during operation of the printer, an obstruction occurs between the printhead 3 and the platen 75, such as a paper jam, the relative dimensioning between the dovetail fingers 51 and 53, the wedge pin 49, and their associated slotways 17, 21, and 15, respectively, is such that the nest assembly 5 will move rearward a predetermined distance, providing that the rearward projection force imparted by the obstruction is of sufficient magnitude to overcome the various forces urging or maintaining the printhead 3 toward the platen 75. In other words, if an obstruction such as a paper jam begins to develop, when a sufficient force is exerted upon the printhead 3 for exceeding the forward bias force exerted by the springs 31 and 36, and the frictional forces between the previously described mechanical interfaces in maintaining the nest assembly 5 and printhead 3 in position, the printhead 3 and nest assembly 5 will move away from the obstruction or paper jam. This design feature substantially prevents damage to the printhead 3, and in many instances permits the developing obstruction or paper jam to clear without interrupting the printing process. The left side of the nest assembly 5, in this example, can be moved rearward a distance limited by either the forward wall of slotway 17 engaging dovetail finger 51 or the forward wall of slotway 21 engaging dovetail finger 53, depending upon the relative dimensioning therebetween. Rearward movement of the right side of the nest assembly 5 is limited by the relative dimensioning between wedge pin 49 and slotway 15, whereby contact between a forward wall of slotway 15 and wedge pin 49 limits the extent of rearward movement thereof. When the paper jam or obstruction is cleared, the springs 31 and 36 (forward biasing springs) will move the printhead 3 back into its normal printing position by pushing the nest assembly 5 within its wedge-like interfaces, as previously described, forward toward platen 75.

The mechanical design parameters of the present invention can be tailored to fit a wide range of operating parameters. The various critical design criteria include the spring rates for the forward biasing springs 31 and 36, the spring rate for the wedge pin biasing spring 45, the type of material used for providing the various mechanical interfaces, including the surface smoothness thereof, the angle of the wedges including the angle and shape of the dovetail fingers 51, 53, dovetail wedge pin 49, dovetail chamfers 19, 23, and 16, and the frictional factors therebetween, including the frictional factors associated with the surface interfaces between the trolley assembly 25 and the bottom of nest assembly 5. These factors contribute to the obstruction force magnitude required for pushing back the printhead 3, for determining the speed or rate of movement of the printhead 3 away from the platen 75 in the event of a developing jam, the speed of return of printhead 3 back toward the platen 75 in the event of clearing of the paper jam or obstruction, and the ease of insertion and removal of the nest assembly 5 from the trolley assembly 25. It is necessary, in this example, to ensure that the force required to remove the ink cartridge 1 from the nest assembly 5 is insufficient for releasing the wedge pin 49 from the slotway 15, whereby the nest assembly 5 and associated printhead 3 will remain attached to the trolley assembly 25 when ink cartridge 1 is removed. Depending upon the system requirements, many different design criteria or system criteria can be satisfied by altering the various mechanical parameters of the system.

Although particular embodiments of the invention have been shown and described in terms of an ink-jet printer, this invention is also applicable to many other printer systems, including matrix printers, in that the previous description was not meant to be limiting. Also let it be understood that other embodiments and modifications of the present invention may occur to those of ordinary skill in the art without departing from the true spirit and scope of the invention. For example, in certain applications it may be preferred to attach three small pads on the bottom of the ink nest assembly 5 beneath slotways 15, 17, and 21, respectively. The pads would provide a "three point" mounting surface for substantially avoiding "rocking" of the nest assembly 5 when mounted upon the trolley assembly 25.

What is claimed is:

1. In a printer, the combination comprising:

a printhead assembly having front and back surfaces connected by opposite sidewalls, and including at least first and second horizontally aligned downwardly projecting chamfered surface means located on said opposite sidewalls of said assembly relative to said printhead, for providing hold-down or fastening surfaces for said assembly;

means providing a mounting surface for receiving said printhead assembly;

at least a first angularly upright projecting finger means rigidly attached to said mounting surface means at a position thereon for slideably engaging an edge of said first chamfered surface means of said printhead assembly;

spring biased wedge pin means rigidly mounted at another position upon said mounting surface means for slideably engaging an edge of said second chamfered surface means of said printhead assembly, for permitting said printhead assembly to be "snapped" into or out of captive retention upon said mounting surface means, wherein when in such captive retention, said wedge pin means both exerts a downward force upon said second chamfered surface means, and another force upon said printhead assembly for pushing said second chamfered surface means of said printhead assembly into engagement with said first finger means, causing the latter to exert a downwardly projecting force upon the former; and leaf-spring means rigidly mounted and positioned upon said mounting surface means for applying a forward projecting force upon the back surface of said printhead assembly.

2. In a printer, the combination comprising:

a printhead assembly including relative to the printhead first and second vertically aligned slotways located at a distance from one another on the left-hand side of said assembly near the ends of that side, and a third vertically aligned slotway centrally located on the right-hand side of said assembly, each one of said first through third slotways terminating near their bottoms in a chamfered or downwardly beveled surface projecting to the face of their respective side;

a trolley assembly upon which said printhead assembly is mountable;

a wedge bracket assembly rigidly attached to the top of said trolley assembly near a left-edge thereof, the former including first and second angularly upright projecting fingers for slideably engaging an edge of the chamfered surfaces of said first and second slotways, respectively, and first leaf-spring means positioned for applying a forward projecting force upon the back surface of said printhead assembly; and a wedge-pin assembly rigidly attached to the top of said trolley assembly near a right-edge thereof, the former including a spring biased wedge pin positioned for slideably engaging an edge of the chamfered surface of said third slotway, and further including second leaf spring means positioned for applying a forward projecting force upon the back of said printhead assembly, said wedge pin being adapted for permitting said printhead assembly to be snapped into or out of captive retention upon the top of said assembly, whereby whenever said printhead assembly is in such captive retention, said wedge pin both exerts a downward force upon the chamfered surface of said third slotway and pushes said printhead assembly toward said wedge bracket assembly, causing said first and second fingers thereof to engage the edges of the chamfered surfaces of said first and second slotways, respectively, and exert a downward force thereupon, concurrent with said first and second leaf spring means urging said printhead assembly toward the front of said trolley assembly.

3. In a printer, the combination comprising:

an ink nest assembly including a front facial surface for receiving a printhead for rigid mounting thereupon, a back or rear facial surface, a bottom, and a right side and left side, relative to said front facial surface;

said ink nest assembly further including at least a first vertical slotway on its left side, and at least a second vertical slotway on its right side, said first and second slotways each terminating before the bottom of said assembly;

a trolley assembly including:

a top surface for mounting thereupon said ink nest assembly;

first retaining means for both slideably engaging the termination portion of said first slotway and imparting a downwardly projecting force thereto; and second retaining means for both slideably engaging the termination portion of said second slotway and imparting a downwardly projecting force thereto, said second retaining means including releasable means for providing easy engagement or disengagement of said second retaining means with said second slotway;

the combination of said first and second retaining means providing for retaining said ink nest assembly upon the top surface of said trolley assembly;

the widths of said first and second slotways being predetermined relative to said first and second retaining means, respectively, for permitting said ink nest assembly to slide backward and forward within a range while held captive upon said trolley assembly by said first, second and third retaining means; and spring biasing means mounted upon the back portion of the top of said trolley assembly, for urging said ink nest assembly toward the front of said trolley assembly to a "normal printing position", while permitting said ink nest assembly to slide back in the event of an obstruction occurring between said printhead and a platen, thereby providing protection for said printhead, and providing within a range automatic clearance of developing obstructions.

4. The printer of claim 3 further including:

a third vertical slotway on the left side of said ink nest assembly spaced apart from said first vertical slotway, and terminating before the bottom of said assembly;

said trolley assembly further including third retaining means for both slideably engaging the termination portion of said third slotway and imparting a downwardly projecting force thereto.

5. The printer of claim 4, wherein the termination portion of each of said first, second and third slotways include a downwardly projecting chamfered surface.

6. The printer of claim 4, further including:

the widths of said first, second and third slotways being predetermined relative to said first, second, and third retaining means, respectively, for permitting said ink nest assembly to slide forward and backward within a range while held captive upon said trolley assembly by said first and second retaining means; and spring biasing means mounted upon the back portion of the top of said trolley assembly, for urging said ink nest assembly forward to a "normal" printing position, while permitting backward movement of said ink nest assembly in the event of an obstruction occurring between said printhead and a platen, thereby both protecting said printhead and substantially aiding in automatically clearing developing obstructions.

7. The printer of claim 6, wherein said first and third retaining means each comprise an upwardly projecting finger having a beveled leading front face for contacting the leading edges of the chamfered terminating portions of said first and third slotways, respectively.

8. The printer of claim 6, wherein said second retaining means includes a wedge pin having a beveled front face at one end for contacting the leading edge of the chamfered terminating portion of said second slotway.

9. The printer of claim 8, wherein said releasably means of said second retaining means includes:

a housing for slideably retaining a portion of said wedge pin, the other end of said wedge pin opposite its front face being made larger than the inside dimension of said housing for preventing said wedge pin from being pushed through said housing, and for ensuring a maximum protrusion of the front face of said wedge pin from said housing; and a leaf spring having one end rigidly connected to the top surface of said trolley assembly, and another free end positioned for applying a spring biasing against the other end of said wedge pin.

10. In a printer, the combination comprising:

an ink nest assembly including a mounting boss on a front facial surface for receiving a printhead, and ink nesting means located on a top surface for receiving an ink cartridge;

a trolley assembly including a top surface for receiving and providing a mounting surface for a bottom surface of said ink nest assembly;

locking means for permitting said ink nest assembly to be "snapped" onto or removed from said trolley assembly, including:

a wedgeplate assembly rigidly located on one side of the top surface of said trolley assembly, said wedgeplate assembly including first and second upwardly projecting stubs spaced apart from one another;

a wedge pin assembly rigidly located on the other side of the top surface of said trolley, said wedge pin assembly including a wedge-pin housing, a wedge pin slideably mounted within said wedge-pin housing, said wedge pin having a flange at one end for preventing it from being pushed out of said housing in a direction towards the other end of said wedge pin, and spring biasing means positioned for pushing said wedge pin at its flanged end for resiliently maintaining said wedge pin in said housing;

first and second vertical slotways spaced apart on one side of said ink nest assembly, said slotways each terminating at a downwardly projecting chamfered surface to the face of said one side, said first and second upwardly projecting stubs of said wedgeplate assembly being shaped for coating with the chamfered surface terminations of said first and second vertical slotwyas, for applying a downward force upon said one side of said ink nest assembly;

a third vertical slotway located on the other side of said ink nest assembly, said third slotway terminating at a downwardly projecting chamfered surface to the face of said other side, said wedge pin having its end opposite its flanged end shaped for coacting with the chamfered surface termination of said third vertical slotway, for applying a downward force upon the other side of said ink nest assembly, the coaction of said first and second stubs and said wedge pin with said first through third slotways, respectively, acting to hold the bottom face of said ink nest assembly against the top face of said trolley assembly;

said first, second and third vertical slotways being wider than the widths of said first and second stubs, thereby permitting said ink nest assembly to be slideably mounted upon trolley assembly for a small degree of forward or backward movement; and resilient means mounted upon said trolley assembly for providing a spring bias upon the back or rear facial surface of said ink nest assembly, for urging the latter to slide in a frontward direction relative to said printhead, whereby upon the event of an obstruction between said printhead and an opposing platen, said resilient means permits said ink nest assembly to move rearward for both protecting said printhead and assisting in clearing said obstruction.

11. The printer of claim 10, wherein said resilient means includes:

first and second leaf springs each having one end rigidly mounted upon said wedgeplate assembly and said wedge pin assembly, respectively, and a free end positioned for exerting a forwardly directed spring bias upon different areas of the rear face of said ink next assembly.

12. The printer of claim 11, wherein antifriction means are rigidly attached to the inside surface of free ends of said first and second leaf springs, for reducing the friction at the areas of contact between said first and second leaf springs and said ink nest assembly.

13. The printer of claim 10, wherein said spring biasing means of said wedge pin assembly consists of a leaf spring.

14. The printer of claim 10, wherein with respect to said first, second and third slotways, each include rearwardmost and forwardmost inside walls with respect to the location of said mounting boss, and the positioning of either one or a combination of said rearwardmost and forwardmost inside walls of said first, second and third slotways determine the range of forward and rearward movement of said printhead, respectively, the forwardmost positioning of said printhead being the normal printing position.

15. The printer of claim 10, wherein only an edge of the chamfered surface terminations of said first, second and third vertical slotways are contacted by said first and second stubs of said wedgeplate assembly, and said wedge pin, respectively, for both positioning and holding said ink nest assembly upon said trolley assembly with a downwardly projecting force, while substantially minimizing frictional forces.

* * * * *